US007501085B2

(12) United States Patent
Bodaghi et al.

(10) Patent No.: US 7,501,085 B2
(45) Date of Patent: Mar. 10, 2009

(54) MELTBLOWN NONWOVEN WEBS INCLUDING NANOFIBERS AND APPARATUS AND METHOD FOR FORMING SUCH MELTBLOWN NONWOVEN WEBS

(75) Inventors: Hassan Bodaghi, Alpharetta, GA (US); Mehmet Sinangil, Duluth, GA (US)

(73) Assignee: Aktiengesellschaft Adolph Saurer, Arbon (CH)

( * ) Notice: Subject to any disclaimer, the term of this patent is extended or adjusted under 35 U.S.C. 154(b) by 671 days.

(21) Appl. No.: 10/904,002

(22) Filed: Oct. 19, 2004

(65) Prior Publication Data

US 2006/0084341 A1 Apr. 20, 2006

(51) Int. Cl.
*B27N 3/04* (2006.01)

(52) U.S. Cl. ..... 264/115; 156/167

(58) Field of Classification Search ..... None
See application file for complete search history.

(56) References Cited

U.S. PATENT DOCUMENTS

| | | | | |
|---|---|---|---|---|
| 3,672,802 | A | 6/1972 | Matsui et al. | 425/131.5 |
| 3,681,189 | A | 8/1972 | Matsui et al. | 428/373 |
| 4,988,560 | A | 1/1991 | Meyer et al. | 428/297 |
| 5,141,699 | A | 8/1992 | Meyer et al. | 264/518 |
| 5,207,970 | A | 5/1993 | Joseph et al. | 264/518 |
| 5,803,106 | A | 9/1998 | Cohen et al. | 137/13 |
| 5,814,404 | A | 9/1998 | Rutherford et al. | 428/364 |
| 5,895,710 | A | 4/1999 | Sasse et al. | 443/334 |
| 5,993,943 | A | 11/1999 | Bodaghi et al. | 428/198 |
| 6,182,732 | B1 | 2/2001 | Allen | 156/441 |
| 6,269,513 | B1 | 8/2001 | Torobin | 15/104.93 |
| 6,308,509 | B1 | 10/2001 | Scardino et al. | 57/402 |
| 6,465,095 | B1 | 10/2002 | Dugan | 428/373 |
| 6,491,507 | B1 | 12/2002 | Allen | 425/7 |

(Continued)

FOREIGN PATENT DOCUMENTS

DE 199 29 709 12/2000

(Continued)

OTHER PUBLICATIONS

European Patent Office, *International Search Report issued in Related Application No. PCT/US2005/O34870*, Date of Mailing: Mar. 2, 2006.

(Continued)

*Primary Examiner*—Mary Lynn F Theisen
(74) *Attorney, Agent, or Firm*—Moore & Van Allen PLLC

(57) ABSTRACT

Apparatus and method for forming nanofibers and nonwoven webs formed of such nanofibers. The nanofibers are formed by changing the rheology in at least first and second flows of a liquid material such that the changed rheology of the first and second flows differs by an amount sufficient to produce a phase separation when the first and second flows are combined to define meltblown fibers. Each meltblown fiber has lengthwise first and second cross-sectional regions formed of the liquid material from the first and second flows, respectively. These regions are separated along a length of at least a majority of the meltblown fibers to form a plurality of nanofibers, which are collected together with any unsplit meltblown fibers to form the nonwoven web. The difference in the changed rheology of the flows may be produced by using two extruders with different barrel diameters to create differ shear histories for the two flows.

18 Claims, 9 Drawing Sheets

U.S. PATENT DOCUMENTS

| | | | | |
|---|---|---|---|---|
| 6,554,881 | B1 | 4/2003 | Healey | 55/528 |
| 6,565,344 | B2 | 5/2003 | Bentley et al. | 425/72.2 |
| 6,686,303 | B1 | 2/2004 | Haynes et al. | 442/327 |
| 6,695,992 | B2 | 2/2004 | Reneker | 264/29.1 |
| 6,753,454 | B1 | 6/2004 | Smith et al. | 602/41 |
| 6,776,858 | B2 | 8/2004 | Bansal et al. | 156/62.4 |
| 6,780,357 | B2 | 8/2004 | Dugan et al. | 264/78 |
| 2002/0034909 | A1 | 3/2002 | Bansal et al. | |
| 2003/0180407 | A1 | 9/2003 | Bentley et al. | 425/72.2 |
| 2003/0203695 | A1 | 10/2003 | Polanco et al. | 442/365 |
| 2004/0161994 | A1 | 8/2004 | Arora et al. | 442/361 |
| 2005/0032450 | A1 * | 2/2005 | Haggard et al. | 442/327 |

FOREIGN PATENT DOCUMENTS

| | | |
|---|---|---|
| EP | 0138556 | 4/1985 |
| EP | 1239065 | 9/2002 |
| WO | WO 97/21862 | 6/1997 |
| WO | WO 01/46507 | 6/2001 |

OTHER PUBLICATIONS

Steven Ashley, *Taking Fabrics for an Electrospin*, Mechanical Engineering, 00256501, Sep. 1997, vol. 119, Issue 9 (2 pages).

Fridrikh, S.V., *Physics of Electrostatic Production of Nanofibers* (*Electrospinning*), Fiber Society. Symposium (Abstracts), Oct. 16-18, 2002 (2 pages).

*Web-Thin 'Micracle' Fiber Offers Impenetrable Protection*, Technology Bulletin, Design News, Jul. 7, 1997 (1 page).

*Fibers Electrospun from Waste*, R&D Magazine, Emerging Technologies, Nov. 2003 (1 page).

Lyons, J., *Melt Electrospinning of Thermoplastic Polymers*, Fiber Society. Symposium (Abstracts), Oct. 16-18, 2002 (3 pages).

You-Lo Hsieh et al., *Nano-Porous Ultra-High Specific Surface Fibers*, National Textile Center Research Briefs, Chemistry Competency, Jun. 2004 (2 pages).

International Patent Application No. PCT/US2005/034870, International Preliminary Report on Patentability, dated Feb. 27, 2007.

International Patent Application No. PCT/US2005/034870, Written Opinion, dated Feb. 27, 2007.

* cited by examiner

MELTBLOWN NONWOVEN WEBS INCLUDING NANOFIBERS AND APPARATUS AND METHOD FOR FORMING SUCH MELTBLOWN NONWOVEN WEBS

FIELD OF THE INVENTION

The present invention generally relates to nonwoven webs and, more particularly, to nonwoven webs formed from a majority of meltblown nanofibers, and to apparatus and methods for forming these nonwoven webs.

BACKGROUND OF THE INVENTION

Melt spun nonwoven webs may be made by a number of processes. The most popular processes are meltblowing and spunbonding, both of which involve melt spinning of thermoplastic material. Meltblowing is a manufacturing process for nonwoven webs in which a molten thermoplastic material is extruded from a row of outlets in a die tip. The streams of thermoplastic material exiting the die tip are immediately contacted with sheets or jets of hot air to attenuate the fibers. The fibers are then deposited onto a collector in a random manner and form a nonwoven web used in such products as diapers, surgical gowns, carpet backings, filters and many other consumer and industrial products.

Generally, meltblown fibers are formed by extruding a low viscosity (i.e., high melt flow rate) thermoplastic material through an array of holes in a meltblown die and impinging the extruded material with high velocity heated air. The resulting fibers have an averaging diameter of between two and five microns. Meltblown fibers are commonly formed from multiple components in which each component may include a unique thermoplastic material having a different chemical composition.

Nonwoven webs of meltblown nanofibers may be made by a process known as electro-spinning that generally involves spinning a solvent-diluted low viscosity polymer in the presence of a directional electric field. Such nonwoven webs, which are characterized by nanofibers of a sub-micron fiber diameter, are known to have utility in a number of applications, such as filtering of particles from fluid streams, for example from air streams and liquid (e.g. non-aqueous and aqueous) streams. In such filtration applications, the interstitial spaces between the nanofibers define small pores that increase the filtration efficiency of the nonwoven. Nonwovens formed from nanofibers also permit the use of lower basis weight, which reduces the cost of products constructed from those nonwovens.

Electro-spinning processes suffer from multiple disadvantages, including the need to remove the solvent from the deposited fibers and an inherently low production rate. Moreover, electro-spinning is not practical on a commercial scale for thermoplastic material since commercially used thermoplastic materials cannot be diluted with a solvent without detrimental consequences to the nonwoven web. The high electric fields required to electro-spin undiluted thermoplastic materials are susceptible to breakdown in air and result in unwanted electrical discharges.

For these reasons, it is desirable to provide apparatus and methods for forming nonwoven webs comprising a majority of meltblown nanofibers that overcome the various problems associated with conventional meltblowing methods for forming such nonwoven webs.

SUMMARY OF THE INVENTION

In accordance with an embodiment of the present invention, a method of forming a nonwoven web includes establishing a first and second flow of liquid material and changing the rheology of the liquid material in the first and second flows. The changed rheology of the second flow differs from the changed rheology of the first flow by an amount sufficient to produce a phase separation between the liquid material in the first and second flows when combined. The method further includes combining the first flow of the liquid material with the changed rheology and the second flow of the liquid material with the changed rheology to form a plurality of meltblown fibers. Each of the meltblown fibers has a length, a first cross-sectional region formed of the liquid material from the first flow, and a second cross-sectional region formed of the liquid material from the second flow. The first and second cross-sectional regions extend along the length of each fiber. The first cross-sectional region is separated from the second cross-sectional region along the length of at least a majority of the meltblown fibers to form a plurality of nanofibers and the nanofibers are then collected to form the nonwoven web. Any un-separated meltblown fibers are collected in the nonwoven web along with the nanofibers.

In yet another aspect of the present invention, a melt spinning apparatus includes a first extruder providing the first flow of a liquid material and a second extruder providing a second flow of the liquid material. The first extruder is configured to change the rheology of the liquid material in the first flow and the second extruder is configured to change the rheology of the second flow to differ from the rheology of the first flow sufficient to produce a phase separation between the liquid material in the first and second flows when combined. The melt spinning apparatus further includes a spinpack coupled with the first and second extruders for receiving the first flow of the liquid material with the changed rheology and the second flow of the liquid material with the changed rheology. The spinpack combines the first flow and the second flow to form a plurality of meltblown fibers each having a length, a first cross-sectional region formed of the liquid material from the first flow, and a second cross-sectional region formed of the liquid material from the second flow. The first and second cross-sectional regions extend along the length of the fiber. The spinpack directs air toward the meltblown fibers with a velocity effective to attenuate and split at least a majority of the meltblown fibers into nanofibers. A substrate collects nanofibers and any unsplit meltblown fibers to form a nonwoven web.

The nanofibers of the nonwoven webs of the present invention have a significantly reduced average diameter as compared with conventional meltblown fibers. Such sub-micron diameters are unachievable with conventional meltblowing processes. For example, the discharge outlet diameter in the die tip of conventional melt spinning apparatus cannot be simply scaled downward without limitation for reducing the fiber diameter. The nanofibers of the present invention provide an enhanced surface area to mass ratio as compared with larger diameter conventional meltblown fibers.

These and other advantages of the present invention shall become more apparent from the accompanying drawings and description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION

For purposes of this description, words such as "vertical", "horizontal", "bottom", "right", "left" and the like are applied in conjunction with the drawings for purposes of clarity and for purposes of defining a frame of reference. As is well-known, melt spinning devices may be oriented in substantially any orientation, so these directional words should not be used to imply any particular absolute directions for a melt spinning assembly or apparatus.

Figure 1:
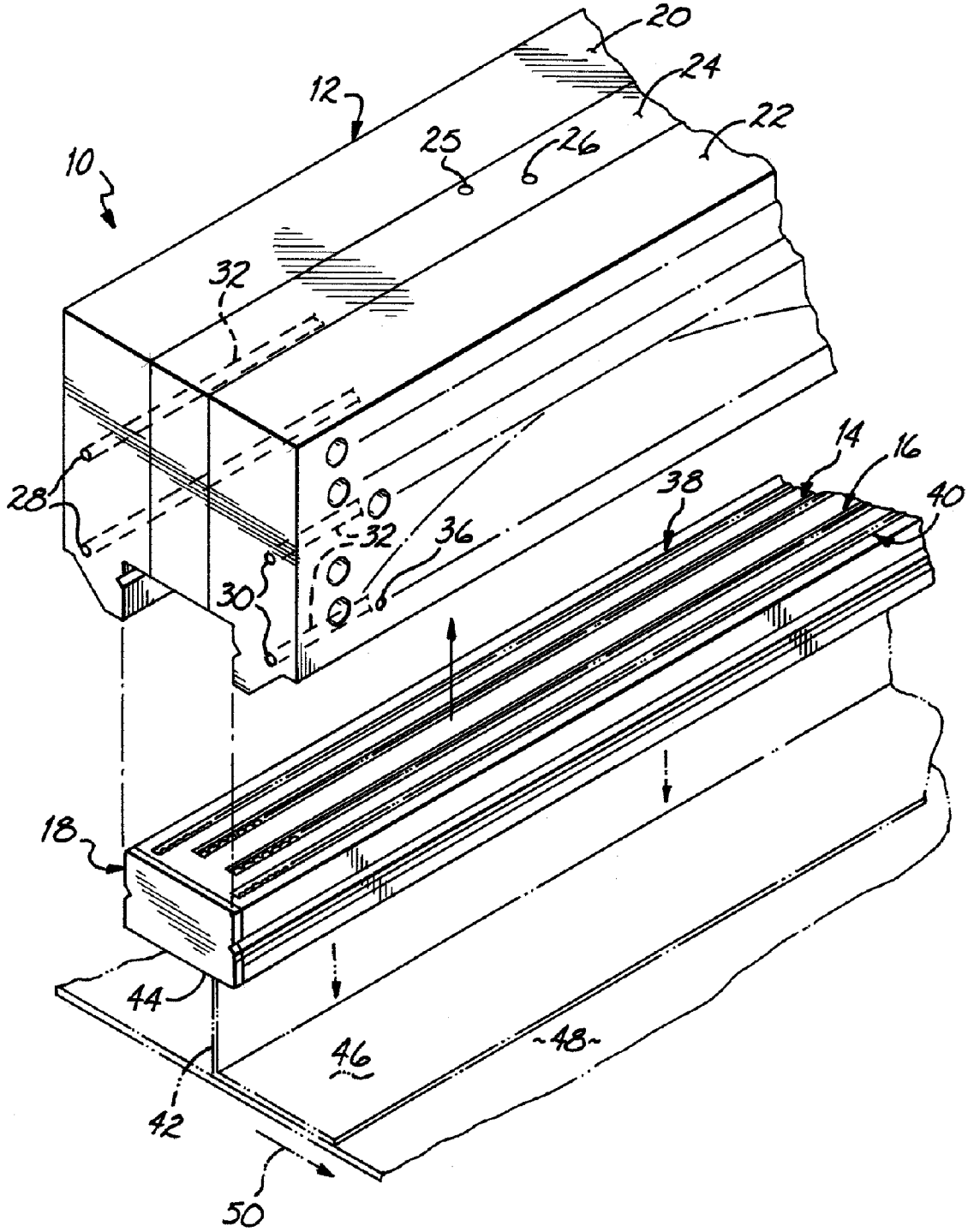
FIG. 1 is an exploded perspective view of a melt spinning assembly for producing fibers in accordance with the invention.

With reference to FIG. 1, a melt spinning assembly 10 constructed in accordance with the inventive principles includes a manifold assembly 12 for supplying liquid material to liquid inputs 14, 16 of a spinpack 18. The inputs 14 and 16 are sealed to the manifold assembly 12 such as by static seals retained within recesses (not shown) around each input 14, 16. The manifold assembly 12 includes first and second outer manifold elements 20, 22 coupled by an intermediate manifold element 24. An upper surface of intermediate manifold element 24 includes first and second liquid supply inlets 25, 26. Gear pumps 150, 151 (FIG. 8) each pump a respective flow of a chemically-identical liquid material from one of first and second extruders 202, 206 (FIGS. 8-10) to a corresponding one of the first and second liquid supply inlets 25, 26. Such chemically-identical solid source materials are characterized by the same composition and identical physical characteristics, such as intrinsic viscosity, melt flow rate, melt viscosity, die swell, density, crystallinity, and melting point or softening point.

Supply inlet 25 communicates with a coat-hanger shaped recess (not shown) defined between outer manifold element 20 and intermediate manifold element 24. The recess provides a first manifold liquid passage to provide liquid material to at least a portion of the longitudinal length of liquid input 14 of the spinpack 18. Similarly, supply inlet 26 communicates with another coat-hanger shaped recess (not shown) defined between outer manifold element 22 and intermediate manifold element 24 that provides a second manifold liquid passage to provide liquid material to at least a portion of the longitudinal length of liquid input 16 of the spinpack 18. The manifold assembly 12 may include a plurality of supply inlets 25, 26 and corresponding first and second manifold liquid passages defined by coat-hanger shaped recesses along its longitudinal length depending on the length of the spinpack 18.

Holes 28 and 30 located along the length of each outer manifold element 20, 22 each receive a heating device, such as an electrical heater rod 32, for independently heating the liquid material in the first and second manifold liquid passages and the process air to an appropriate application temperature. Temperature sensing devices (not shown), such as resistance temperature detectors (RTD's) or thermocouples are also placed in outer manifold elements 20, 22 to independently control the temperature of each flow of liquid material. It should be appreciated by those skilled in the art that various heating systems consistent with aspects of the invention may be appropriately used in different applications.

Outer manifold elements 20, 22 further include a plurality of air supply passages 34, 36 for supplying pressurized air (i.e., process air) to air passage inputs 38, 40 of the spinpack 18. Fibers 42 are extruded along the longitudinal length of the spinpack 18 from a row of discharge outlets 44 (see FIGS. 3-5) and are attenuated by the process air emitted from air supply passages 34, 36. The attenuated fibers 42 form a nonwoven web 46 upon a collector or substrate 48 that generally is moving transverse to the melt spinning assembly 10, such as shown by arrow 50.

Figure 2:
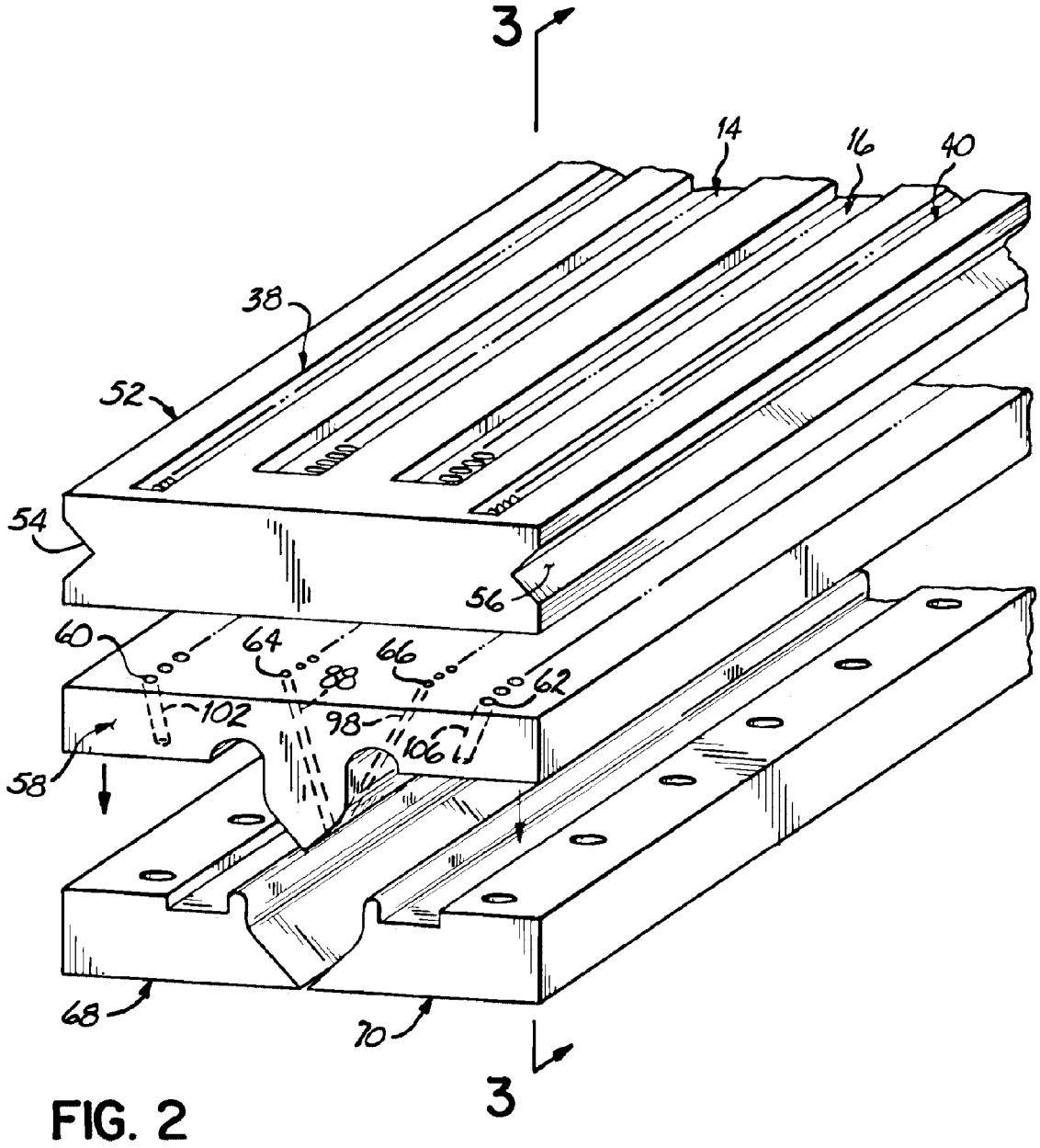
FIG. 2 is an exploded perspective view of one end of a spinpack of the melt spinning assembly of FIG. 1.

With reference to FIG. 2, the spinpack 18 includes the fiber producing features of the melt spinning assembly 10. In particular, spinpack 18 includes a transfer block 52 and a die tip block 58, attached below the transfer block 52 to form a die tip. The transfer block 52 includes longitudinal side recesses 54, 56 for mounting the spinpack 18 to the manifold assembly 12, the liquid inputs 14, 16 and air passage inputs 38, 40. The die tip block 58 includes first and second rows of air passages 60, 62 and first and second rows of liquid passages 64, 66. Attached below the die tip block 58*a* is pair of air knife plates 68, 70.

Figure 3:
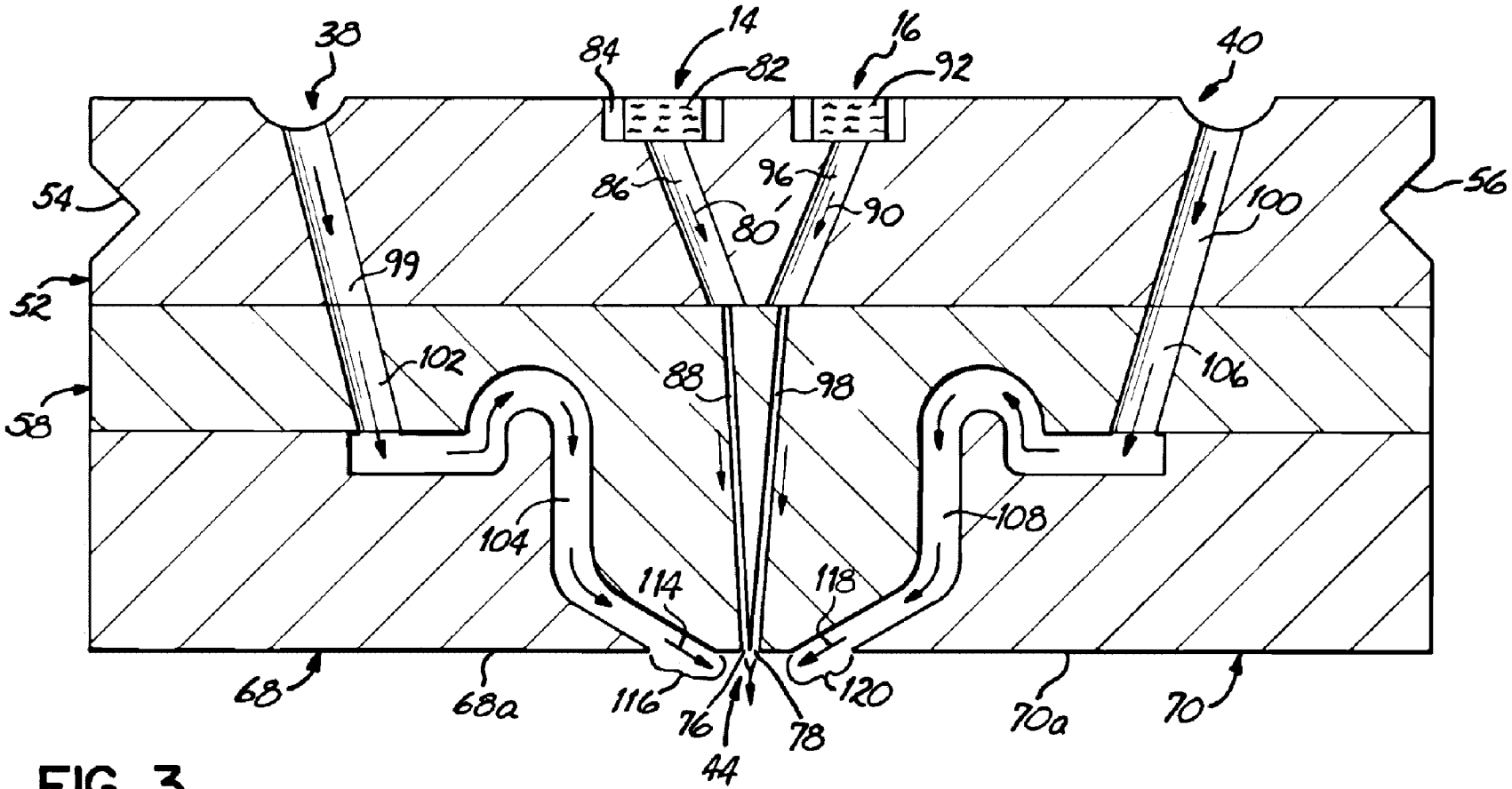
FIG. 3 is a cross-sectional view taken generally along line 3-3 of FIG. 2, but illustrating the spinpack in assembled condition.
Figure 4:
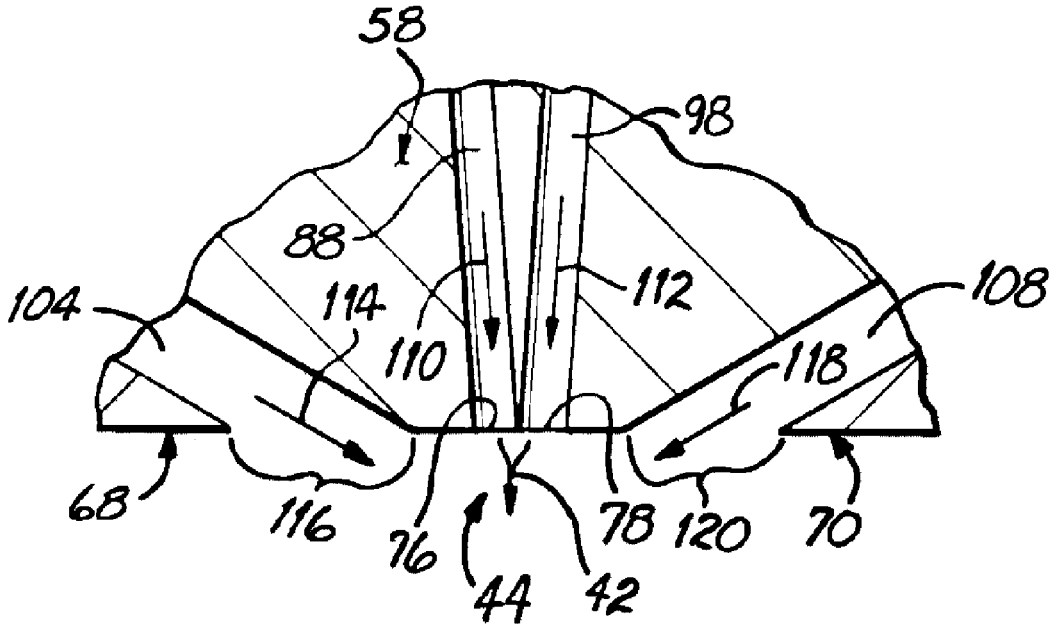
FIG. 4 is an enlarged cross-sectional view of the discharge region of the die tip of the spinpack of FIG. 3.
Figure 5:
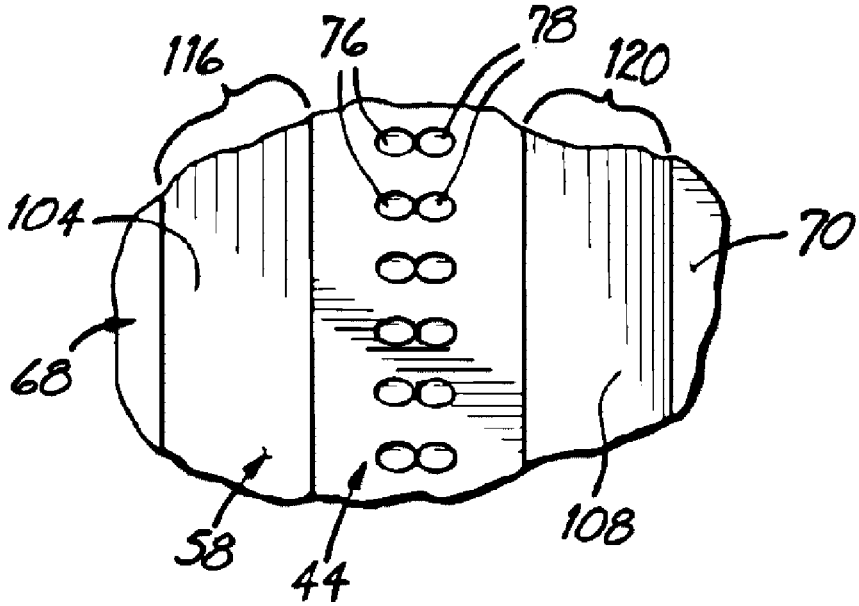
FIG. 5 is a partial bottom view of the assembled spinpack of FIG. 3.

With reference to FIGS. 3-5, the spinpack 18 is depicted in assembled condition showing how the process air and the two streams 110, 112 of liquid material are brought together at each discharge outlet 44. First and second flows 80, 90 of the liquid material are kept separate from one another in respective flow paths throughout the entire spinpack 18 and are extruded separately as streams 110, 112. In particular, one of the streams 110 of liquid material is extruded at a plurality of first outlets 76 and the other of the streams 112 of liquid material is extruded at a plurality of second outlets 78, each second outlet 78 adjacent to a corresponding one of the first outlets 76.

In particular, the liquid material supplied from the manifold assembly 12 enters the first liquid input 14 in the transfer block 52 of the spinpack 18 to form the first flow 80. Liquid material in the first flow 80 encounters a first filter 82 disposed within a first filter recess 84 for entrapping contaminants. The first flow 80 continues through a first liquid transfer passage 86, which may be a single longitudinal slot or a series of passages each longitudinally aligned with one of the first outlets 76. The die tip block 58 has a longitudinally aligned row of first die tip liquid passages 88 communicating between the first liquid transfer passage 86 in the transfer block 52 and with a respective one of the first outlets 76 in the die tip block 58.

Similarly, another supply of the liquid material from the manifold assembly 12 enters the second liquid input 16 in the transfer block 52 of the spinpack 18 to form the second flow 90. Liquid material in the second flow 90 encounters a second filter 92 disposed within a second filter recess 94 for entrapping contaminants. The second flow 90 continues through a second liquid transfer passage 96, which may be a single longitudinal slot or a series of passages each longitudinally aligned with one of the second outlets 78. The die tip block 58 has a longitudinally aligned row of second die tip liquid passages 98 communicating between the second liquid transfer passage 96 in the transfer block 52 and with a respective one of the second outlets 78 in the die tip block 58.

The transfer block 52 includes a first air transfer passage 99 that communicates with the first air passage input 38 and a second air transfer passage 100 that communicates with the second air passage input 40. The die tip block 58 includes a first die tip air passage 102 that communicates between the first air transfer passage 99 and a converging air channel 104 formed between the air knife plate 68 and the die tip block 58. Similarly, the die tip block 58 includes a second die tip air passage 106 that communicates between the second air transfer passage 100 and a converging air channel 108 formed between the air knife plate 70 and the die tip block 58. The air channels 104, 108 may be mutually aligned symmetrically relative to the first and second outlets 76, 78 and with an included angle of, for example, between about 60° and about 90°.

With particular reference to FIG. 4, the first flow 80 is extruded from one of the first outlets 76 as a single-component strand or stream 110 and the second flow 90 is extruded from one of the second outlets 78 as a single-component strand or stream 112. The first and second streams 110, 112 thereafter combine into a fiber 42 having a side-by-side cross-sectional configuration. Bonding or combining is promoted by the proximity of the first and second outlets 76, 78 and the converging orientation of the first and second die tip liquid passages 88, 98.

With particular reference to FIG. 5, each pair of adjacently positioned first and second outlets 76, 78 are shown to tangentially meet. Consequently, the streams 110, 112 of liquid material do not contact one another until after extrusion. Each outlet 76, 78 is oblong due to the non-perpendicular orientation of the corresponding die tip liquid passages 88, 98 with respect to a bottom, external surface of the die tip block 58.

A first air jet 114 exits air channel 104 at a first spin slot 116 and is directed at each fiber 42. A converging, second air jet 118 exits air channel 108 at a second spin slot 120 and is directed at the fiber 42. Generally, the air temperature of the air flow from air jets 114, 118 is approximately equal to the temperature of the material constituting the fibers 42. The high velocity air flow from the air jets 114, 118 impinges and attenuates the fibers 42.

Spinpack 18 provides two flows 80, 90 of liquid material ultimately forming individual streams 110, 112 at discharge outlets 44 that are combined post-extrusion into fiber 42. There is substantially no physical interaction or contact between the two flows 80, 90 of liquid material before extrusion. The two individual streams 110, 112 are urged together by the momentum of extrusion to define fibers 42. However, the invention contemplates that the spinpack 18 may have a different configuration in which the flows 80, 90 of liquid material are combined before fibers 42 are extruded from discharge outlets 44. Specifically, any spinpack 18 capable of forming multicomponent fibers in a meltspinning apparatus may be used in the present invention. Melt spinning assembly 10 is further described in U.S. Pat. No. 6,565,344, the disclosure of which is hereby incorporated by reference herein in its entirety.

Figure 6:
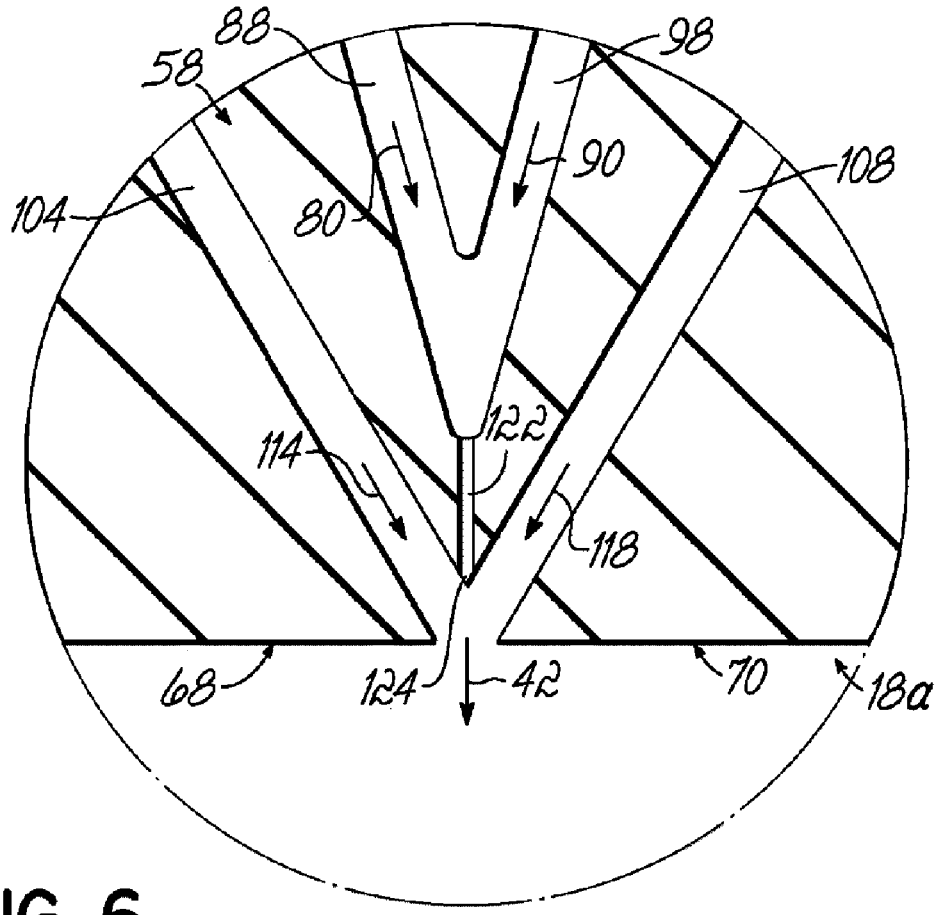
FIG. 6 is an enlarged cross-sectional view similar to FIG. 4 of a die tip of another spinpack for producing fibers in accordance with the present invention.
Figure 7:
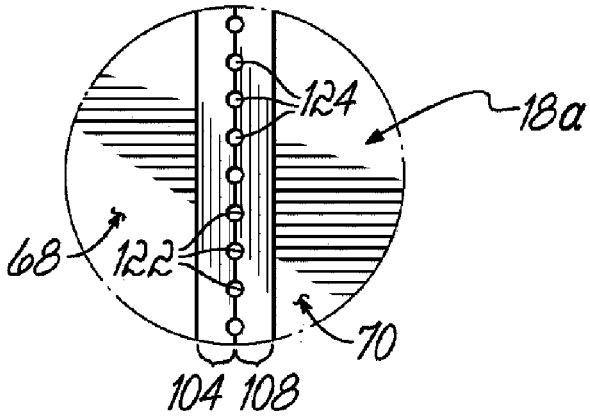
FIG. 7 is a partial bottom view of the assembled spinpack of FIG. 6.

With reference to FIGS. 6 and 7 in which like reference numerals refer to like features in FIGS. 1-5, a portion of a different spinpack **18*a* for use with melt spinning assembly 10 is described in which the two flows 80, 90 of liquid material flowing in liquid passages 88, 98 intersect and become merged inside of the spinpack 18*a*. In other aspects, the spinpack 18*a* is substantially identical to spinpack 18 (FIGS. 1-5). Downstream of the intersection between liquid passages 88, 98, the merged flow is directed into one of a plurality of passageways 122. Each passageway 122 emerges from the spinpack 18*a* at a corresponding one of a plurality of discharge outlets 124, which extend in a row across the width of the spinpack 18*a*. The flows 80, 90 are separated in the spinpack 18 and are combined only immediately prior to reaching the discharge outlets 124. The merged flows 80, 90 extruded from each discharge outlet 124 define one of a plurality of fibers 42 subsequently collected on substrate 28 (FIG. 1) to form the nonwoven web 46 (FIG. 1**).

Flanking the discharge outlets 124 are spin slots 116, 120 that emerge from respective air channels 104, 108 of the spinpack **18*a*. The air jets 114, 118 of pressurized process air, typically heated, emitted from these spin slots 116, 120 impinge the fiber 42, which attenuates and splits the fiber 42 consistent with the principles of the present invention. The air channels 104, 108 of FIG. 6 are angled with a different included angle than shown in FIGS. 3 and 4, so that the corresponding air jets 114, 118 converge at a different inclination relative to the fibers 42 but, nevertheless, split and attenuate fibers 42. Spin pack 18*a*, as well as spinpack 18 (FIGS. 1-5), is configured to produce fibers 42 consistent with the principles of the invention. Accordingly, spinpack 18*a* may be substituted for spinpack 18 in the melt spinning assembly 10**.

Figure 8:
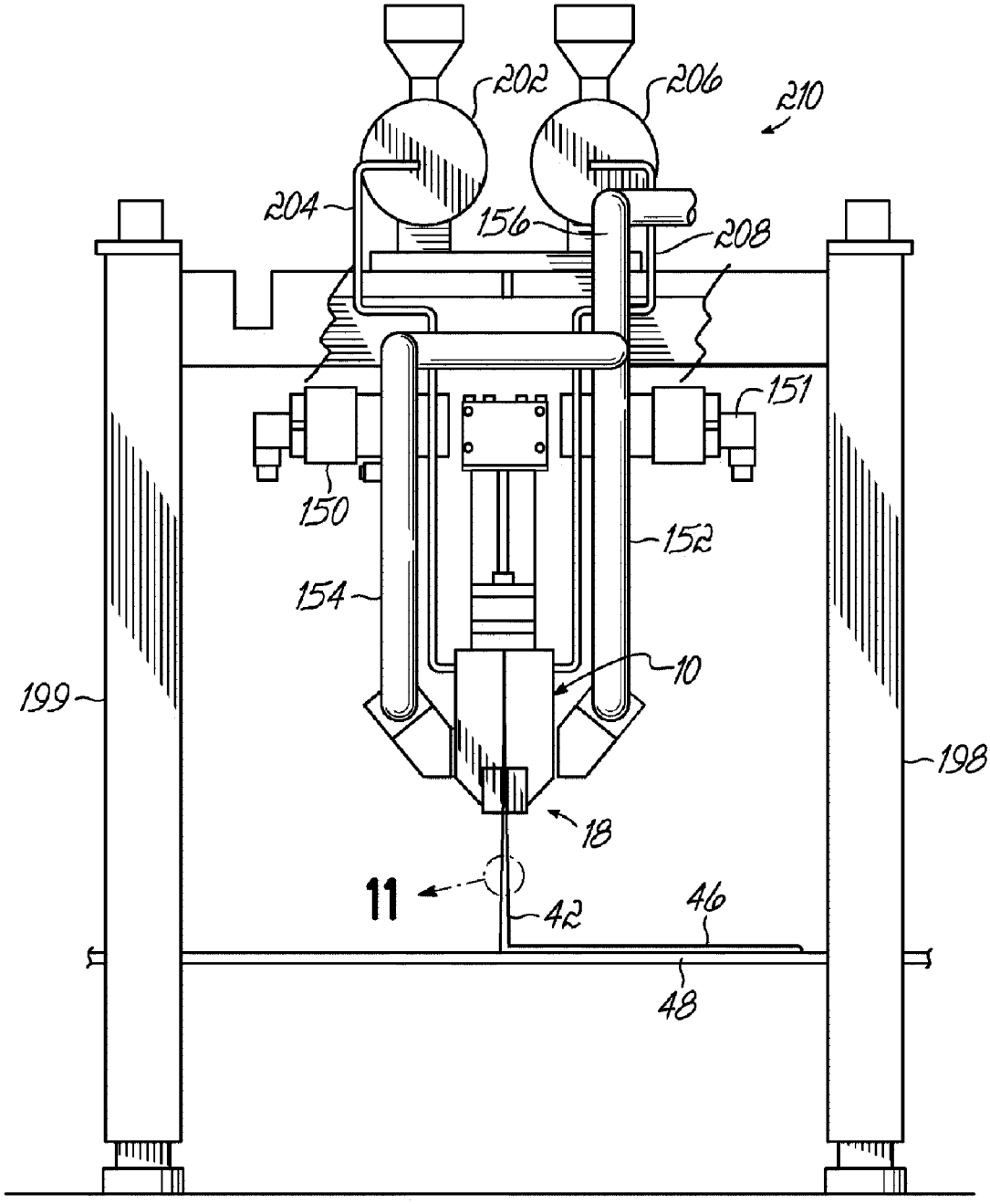
FIG. 8 is a diagrammatic side view of a meltblowing apparatus incorporating a melt spinning assembly for forming fibers in accordance with the present invention.

With reference to FIG. 8, melt spinning assembly 10, including the spinpack 18 or optionally spinpack **18*a*, is installed in a meltspinning apparatus 200, which may be any suitable conventional meltspinning apparatus or, for example, the apparatus disclosed in U.S. Pat. No. 6,182,732, the disclosure of which is hereby fully incorporated by reference herein. The apparatus 200 generally includes a first extruder 202 with a feed line 204 for feeding a first flow of the liquid material to the melt spinning assembly 10 and a second extruder 206 with a feed line 208 for feeding a second flow of the liquid material to the melt spinning assembly 10. The spinpack 18 is configured to thermally isolate the two flows 80, 90 (FIG. 3) of liquid material from each other while inside spinpack 18. The melt spinning assembly 10 is supported by columns 198, 199 of a support structure and suspended above substrate 48 so that the fibers 42 deposit on substrate 48 to form nonwoven web 46**.

Melt spinning apparatus 200 further includes a pair of gear pumps 150, 151 each of which receives liquid material from one of the feed lines 204, 208 and pumps the received liquid material to one of the first and second liquid supply inlets 25, 26 (FIG. 1) in the respective outer manifold elements 20, 22 for delivery to the liquid inputs 14, 16 (FIG. 1) of the spinpack 18. Branching from a single inlet duct 156 is a pair of air supply ducts 152, 154 that deliver process air to the air supply passages 34, 36 in the outer manifold elements 20, 22, respectively. The various other details of the meltspinning apparatus 200, such as, for example, a system controlling the operation of the apparatus 200 and quench air outlets for cooling the fibers 42 after forming, are not described herein as these details will be readily understood by those of ordinary skill in the art.

Figure 9:
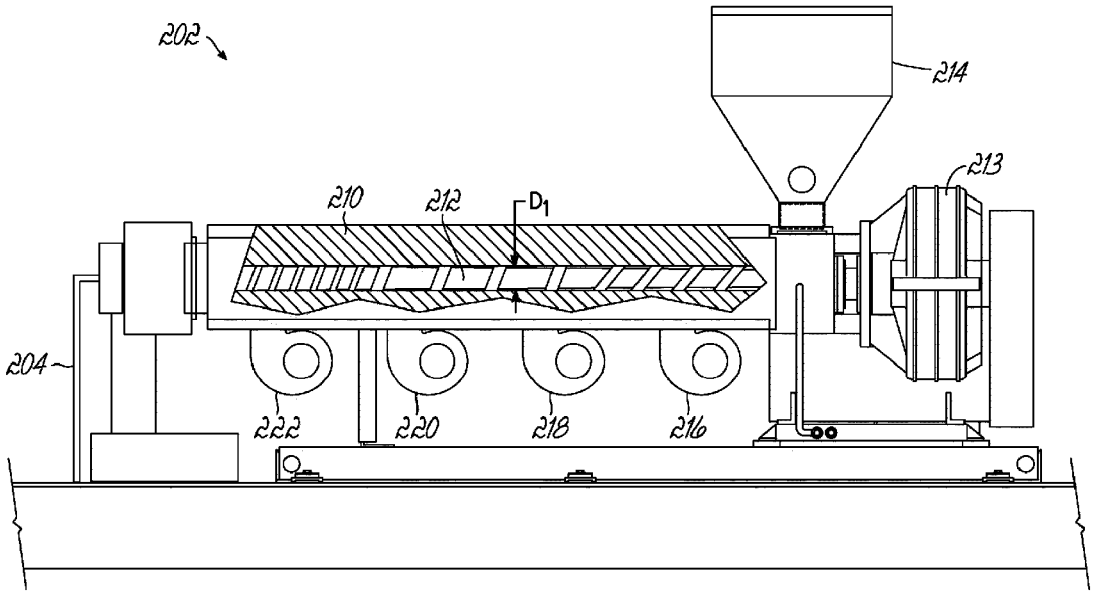
FIGS. 9 and 10 are diagrammatic views in partial cross-section of the extruders of the meltblowing apparatus of FIG. 8.

With reference to FIG. 9 in which like reference numerals refer to like features in FIG. 8, the first extruder 202 includes a cylinder or barrel 210, a screw 212 stationed within the barrel 210, and a hopper 214 that receives and melts amounts of a solid source material to provide molten liquid material. The barrel 210, which is heated along its length across four separate zones by heaters 216, 218, 220, 222, defines a cylindrical housing within which the screw 212 rotates. The temperature of the liquid material advancing in the barrel 210 incrementally increases across the zones of barrel 210 associated with heaters 216, 218, 220, 222, respectively. The screw 212 is powered by a motor 213 and includes a helically flighted shaft that rotates within the barrel 210 to advance liquid material delivered to the barrel 210 from hopper 214 to feed line 204. The space between the flight bounded by the screw 212 and the cylindrical bore of the barrel 210 defines a channel for fluid transport in the first extruder 202 to the first feed line 204. Operation of the first extruder 202 changes the rheology of the liquid material in the first flow 80.

Figure 10:
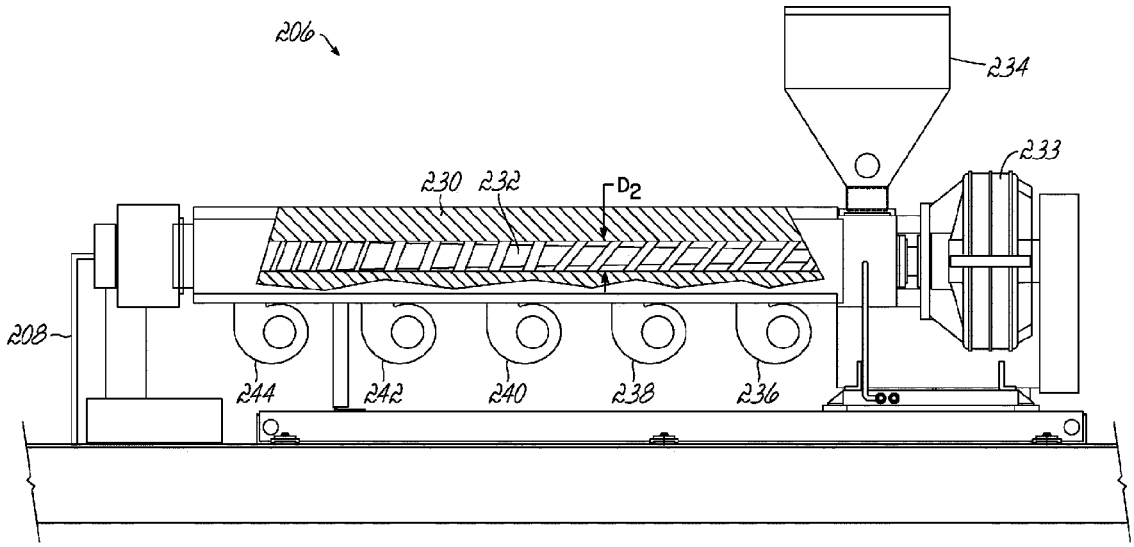

With reference to FIG. 10 in which like reference numerals refer to like features in FIG. 8, the second extruder 206 is similar in construction to the first extruder 202. The second extruder 206 includes a cylinder or barrel 230, a screw 232 stationed within the barrel 230, and a hopper 234 that receives and melts amounts of a solid source material to provide molten liquid material. Barrel 230, which is heated along its length across five separate zones by heaters 236, 238, 240, 242, 244, defines a cylindrical housing within which the screw 232 rotates. The temperature of the liquid material advancing in the barrel 230 incrementally increases across the zones of barrel 230 associated with heaters 236, 238, 240, 242, 244, respectively. The screw 232 is a helically flighted shaft, which is powered by a motor 233, that rotates within the barrel 230 to advance liquid material delivered to the barrel 230 from hopper 234 to feed line 208. The space between the flight bounded by the screw 232 and the cylindrical bore of the barrel 230 defines a channel for fluid transport in the first extruder 202 to the first feed line 204. Operation of the second extruder 206 changes the rheology of the liquid material in the second flow 90; however, the changed rheology of the second flow differs from the changed rheology of the first flow by an amount sufficient to produce a phase separation between the liquid material in the first and second flows 80, 90 when combined.

The invention contemplates that the first and second hoppers 214, 234 may constitute a single hopper (not shown) into which the chemically-identical solid source material is added and initially melted for subsequent extrusion from the first and second extruders 202, 206. This sharing is possible because the same liquid material is provided in the streams 80, 90 but with different shear histories.

The first and second extruders 202, 206 differ in a manner that causes the liquid material delivered to the spinpack 18 by the first extruder 202 to experience a different shear history (i.e., rheology) than the chemically-identical liquid material delivered to the spinpack 18 by the second extruder 206. The different shear histories in the extruders 202, 206 differentially changes a rheological property of the liquid material, such as viscosity, in each of the two flows 80, 90 in liquid transfer passage 86, 96, respectively. The liquid material in flows 80, 90, which are subjected to different shear histories in the extruders 202, 206, are also subjected to different thermal histories while inside the extruders 202, 206. Shear history is related to thermal history by shear heating, which inherently results from friction caused by fluid flow through passages. As used herein, the differentially change in rheology between the two flows 80, 90 may be provided by mechanical approaches that provide different shear histories and by thermal approaches that use differential heating.

With regard to the specific embodiment of the present invention depicted in FIGS. 9 and 10, a diameter, $D_2$, of the barrel 230 of the second extruder 206 is larger than a diameter, $D_1$, of the barrel 210 of the first extruder 202. As a result, the two flows 80, 90 (FIG. 3) defining streams 110, 112 (FIG. 4) of liquid material that ultimately form fibers 42 are composed of the same liquid material (i.e., chemically identical liquid materials) but have a different rheology due to the difference in shear history inside the extruders 202, 206. The flow paths in the spinpack 18 are identical for the two flows 80, 90 of liquid material, although the invention is not so limited as will be described below.

The shear history of each flow 80, 90 of liquid material is a function of the shear rate experienced by the liquid material in each flow over its individual flow path. The shear rate is the overall velocity across the cross section of the barrels 210, 230 with which the individual liquid material layers constituting each of the flows 80, 90 are gliding along each other or along the wall of the barrels 210, 230 in laminar flow. Among other variables, the difference in shear history may depend upon the different surface area of the barrels 210, 230, different residence times in the respective one of the extruders 202, 206, and different pressure drops during the extrusion process. The stream of liquid material advanced in the smaller-diameter barrel 210 of the first extruder 202 has a different shear history than the stream of liquid material advancing in the larger-diameter barrel 230 of the second extruder 206. The differences in shear history will also inherently result in different thermal histories for the two flows 80, 90 of liquid material due to differences in shear heating inside the extruders 202, 206.

The liquid material forming fibers 42 may be any thixotropic liquid material exhibiting non-Newtonian rheological flow behavior where viscosity depends on the shear history. An amount of solid source material is added to hopper 214, melted, and supplied in molten form to first extruder 202. Another amount of a chemically-identical solid source is added to hopper 234, melted, and supplied in molten form to the second extruder 206. As mentioned above, the chemically-identical solid source materials added to hoppers 214, 234 have the same composition and identical physical characteristics, such as intrinsic viscosity, melt flow rate, melt viscosity, die swell, density, crystallinity, and melting point or softening point.

The solid source material may be any melt-processable thermoplastic polymer selected from among any commercially available meltspun grade of a wide range of thermoplastic polymer resins, copolymers, and blends of thermoplastic polymer resins including, but not limited to, polyolefins, such as polyethylene and polypropylene, polyesters, nylons, polyamides, polyurethanes, ethylene vinyl acetate, polyvinyl chloride, polyvinyl alcohol, and other melt processable polymers. The constituent thermoplastic polymer resin may also be blended with additives such as surfactants, colorants, anti-static agents, lubricants, flame retardants, antibacterial agents, softeners, ultraviolet absorbers, polymer stabilizers, and the like.

Figure 11:
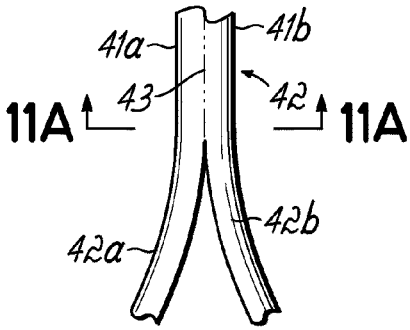
FIG. 11 is a detailed view of a portion of FIG. 8.
Figure 11A:
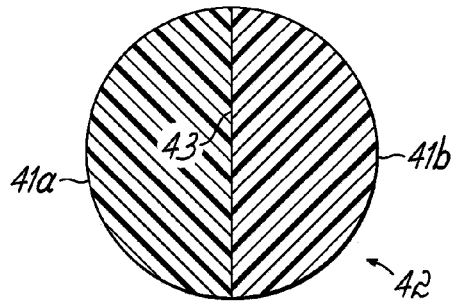
FIG. 11A is a cross-sectional view taken generally along line 11A-11A of FIG. 11.

As shown in FIGS. 11 and 11A, the combined streams 110, 112 (FIG. 4) define two distinct cross-sectional regions 41*a*, 41*b* coextensive along an interface 43 extending axially along the length of the fiber 42. The differing shear histories of the two flows 80, 90 (FIG. 3) defining streams 110, 112 cause a phase separation to occur between regions 41, 41*b*. Due to this phase separation, the regions 41*a*, 41*b* are weakly bonded along interface 43 so that a sufficient force acting on the fiber 42 is capable of splitting the fiber 42 along the interface 43. The phase separation of the two regions 41*a*, 41*b* and the consequential presence of interface 43 results from the inability of the liquid material in region 41*a* to intermix and chemically react with the liquid material in region 41*b*. If the liquid material in the two flows 80, 90 were to have an identical rheology, which they do not, the resulting regions 41*a*, 41*b* would intermix and bond to an extent sufficient to prevent splitting when fiber 42 is exposed to a high velocity streams of process air.

As best shown in FIG. 11, the flow of process air from the air jets 114, 118 (FIG. 4) attenuates the fiber 42 and causes the two regions 41*a*, 41*b* to split apart or divide along the axial interface 43, which defines two smaller diameter daughter fibers 42*a*, 42*b* each corresponding to one of the regions 41*a*, 41*b*. Preferably, the high velocity air flow from air jets 114, 118 attenuates the parent fiber 42 to a smaller diameter than the initial extruded diameter before splitting occurs along interface 43. After splitting, the average fiber diameter of the daughter fibers 42*a*, 42*b* is smaller than the average diameter of each parent fiber 42. For the illustrated side-by-side fiber configuration in which each region 41*a*, 41*b* constitutes half of the total fiber 42, the diameter of the split fibers 42*a*, 42*b* is approximately one-half of the original fiber diameter. As used herein, the diameter of a noncircular cross-section fiber 42 is determined as the equivalent diameter of a circle having the same cross-sectional area.

After the larger parent fibers 42 are split, the properties (e.g., orientation, crystallinity) of the constituent liquid material of the individual split daughter fibers 42*a*, 42*b* are not significantly altered. After splitting, the resulting daughter fibers 42*a*, 42*b* are smaller in diameter than the parent fiber 42 but retain some of the same mechanical properties. Constructing the extruders 202, 206 so that the liquid material forming each of the regions 41*a*, 41*b* has a differential rheology causes relatively weak bonding along the interface 43. Because of this phase separation between the regions 41*a*, 41*b*, the fibers 42 are more susceptible to splitting longitudinally along the length of the interface 43 when exposed to the high-velocity flow of process air. Small diameter fibers 42*a*, 42*b* may be produced with greater attenuation than fibers of the same liquid material extruded directly to equivalent diameters due to the larger effective surface area before splitting. A majority of the parent fibers 42 are split into daughter fibers 42*a*, 42*b*, which are nanofibers having a submicron diameter. Fibers 42*a*, 42*b* and any of the unsplit parent fibers 42 are subsequently deposited as nonwoven web 46 (FIG. 1).

Each fiber 42 is illustrated in FIGS. 11 and 11A as constituted by side-by-side regions 41*a*, 41*b* that are approximately equal in volume and cross-sectional area. However, the invention is not so limited as regions 41*a*, 41*b* may be divided unequally, such as 30% and 70% of the total cross-sectional area. In addition, each fiber 42 may have a different multicomponent configuration, such as a segmented pie, with more than two distinct regions each weakly bonded along an interface created by phase separation, such that more than two individual daughter fibers 42*a*, 42*b* are formed from the larger parent fiber 42 after splitting. The different components of such fibers 42 are arranged in substantially distinct regions, like regions 41*a*, 41*b*, across the cross-section of the fiber and extend continuously along the length of the fiber 42. Adjacent regions in such fibers 42 are formed from liquid material of a different shear history so that these regions are weakly bonded and splittable.

Figure 12:
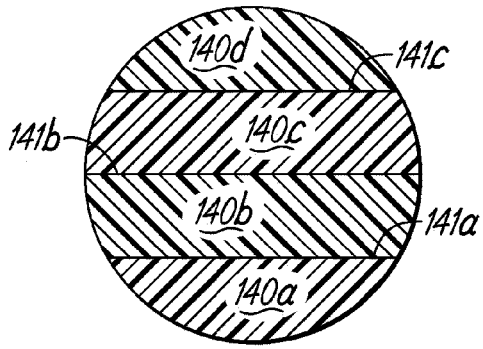
FIG. 12 is a cross-sectional view similar to FIG. 11A of a fiber of the present invention characterized by a different cross-sectional configuration than shown in FIG. 11A.

As another example and with reference to FIG. 12, each fiber 42 may have a circular cross-section and, before splitting into four smaller fibers while in flight from the die tip block 58 to the substrate 48, include four distinct cross-sectional layers or regions 140*a*, 140*b*, 140*c*, 140*d* extending along the length of fiber 42. Adjacent regions 140*a* and 140*b* are formed from first and second flows of liquid material having differing rheology, region 140*c* is formed from a third flow of the liquid material having a different rheology than adjacent region 140*b*, and region 140*d* is formed from a fourth flow of the liquid material having a different rheology than the third liquid material flow. The additional liquid material flows for the two added regions may be supplied from two additional extruders (not shown) like extruders 202, 206 but with each additional extruder capable of imparting a unique shear history to the liquid material flow. Alternatively, the second and fourth liquid material flows may have the same the rheology because regions 140*b* and 140*d* are not adjacent, and the first and third liquid material flows may have the same rheology because regions 140*a* and 140*c* are not adjacent. In this alternative embodiment, each of the liquid material flows 80, 90 from the first and second extruders 202, 206 may be split for defining the regions 140*a-d*. The present invention contemplates that the number of individual regions is not limited to two regions or four regions as in the illustrated embodiments. Instead, fiber 42 may embrace any number of regions of the liquid material arranged such that adjacent regions have been subjected to corresponding shear histories that differ to an extent sufficient to produce splitting in accordance with the principles of the invention.

Because of mutual phase separation between regions 140*a* and 140*b*, regions 140*b* and 140*c*, and regions 140*c* and 140*d*, weakly bonded interfaces 141*a*, 141*b*, 141*c* are defined between adjacent pairs of regions 140*a-d*. As a result, the larger parent fiber 42 will split along each of these interfaces 141*a-c* to define four smaller diameter daughter fibers (not shown) that deposit on substrate 48 to form nonwoven web 46. A majority of the parent fibers 42 subsequently deposited as the nonwoven web 46 (FIG. 1) are split into daughter fibers each corresponding to one of the four regions 140*a-d*, in which each of the split regions 140*a-d* constitutes a nanofiber having a submicron diameter. Fibers 42 with this configuration, but formed from chemically-different liquid materials, are disclosed in U.S. Pat. No. 5,207,970, the disclosure of which is hereby incorporated by reference herein in its entirety.

In alternative embodiments of the invention and with renewed reference to FIGS. 11 and 11A, the differences in the changed rheologies or shear histories of the flows 80, 90 of the liquid material may be created in the melt spinning apparatus 200 by other approaches capable of that differentially changing the shear histories of the two flows 80, 90 by an amount sufficient to cause phase separation between the regions 41*a*, 41*b*. The differential shear history may result from exposing the two flows 80, 90 (FIG. 3) to different shear rates for the same length of time, the same shear rate for different lengths of time, or different shear rates for different lengths of time. For example, the spinpack 18 may be configured to present a path length for the flow 80 of liquid material forming region 41*a* that differs from the path length for the flow 90 of liquid material forming region 41*b*. Another approach is to differentially shear the two flows 80, 90 of liquid material at the gear pumps 150, 151 by suitably adjusting the operation of the gear pumps 150, 151. In addition to configuring the extruders 202, 206 with different barrel diameters, other approaches for imparting a differential change in shear history is to operate extruders 202, 206 of equal barrel diameter at different pressures, to provide extruders 202, 206 of equal different length, to operate identical extruders 202, 206 with different rates, or a combination of these configurations. The heating inside extruders 202, 206 of equal diameter and length may be adjusted so that the flows 80, 90 have different shear histories. Persons of ordinary skill will appreciate that the various approached for differentially changing the shear history may be combined.

The nonwoven webs 46 of the invention may be further processed after collection to enhance the degree of fiber splitting for any fibers 42 not split by the impinging process air from the air jets 114, 118. The nonwoven webs 46 of the invention may have a wide variety of uses where high surface area is important including, but not limited to, filtration media and filtration devices, medical fabrics, sanitary products, apparel fabrics, and thermal or acoustical insulation.

Further details and embodiments of the invention will be described in the following example.

EXAMPLE

Thermoplastic fibers of the configuration shown in FIG. 11A were produced by a melt spinning apparatus 200 configured as described with regard to FIGS. 1-8 and collected to form a nonwoven web 46. The solid source material used in this example was PF017 (2000 MFR) polypropylene, which is commercially available from Basell North America Inc. (Elkton, Md.). Amounts of the solid polypropylene were supplied to the hoppers 214, 234 of the respective extruders 202, 206 and melted. Power to heaters 216, 218, 220, 222 of extruder 202 and power to heaters 236, 238, 240, 242, 244 of extruder 206 were adjusted such that the temperature of the liquid polypropylene supplied to each of the feed lines 204, 208 was about 485° F. The pressure at the outlet of each of the extruders 202, 206 was about 900 psi. The gear pumps 150, 151 were operated at 6.7 revolutions per minute (rpm) and 10 rpm, respectively (or 30 cc/rev and 20 cc/rev, respectively) to provide flows 80, 90 of polypropylene. The melt density of the polypropylene was 0.75 g/cc and the throughput for each stream 110, 112 of polypropylene was 0.135 grams per hole per minute (ghm). The temperature of the process air for air jets 114, 118 exiting air channels 104, 108 was about 500° F. The included angle of the air channels 104, 108 was about 60° and the air gap was about 1.016 mm. The number of first and second outlets 76, 78 was 50 holes per inch with a 0.318 mm hole diameter. The polypropylene streams 110, 112 from the outlets 76, 78 were combined to form fibers 42, as described herein, having side-by-side cross-sectional regions 41*a*, 41*b* of approximately equal area, as shown in FIG. 11A. Nonwoven web 46 was formed by collecting the fibers 42 on a substrate 48 moving at about fifty-five (55) meters per minute relative to the stationary spinpack 18.

The nonwoven web 46 had an average basis weight of 4.6 gsm, an average air permeability of 92.5 cfm at 125 PA, and an average hydrohead of 17.6 mbar at 60 mbar/min, but samples with layer of screen protection exhibited 30 mbar at 60 mbar/min. Due to the difference in the diameter of the barrels 210, 230 of the extruders 202, 206, the polypropylene in the two regions 41*a*, 41*b* are subjected to different shear histories. When exposed to the high velocity process air of air jets 114, 118, the polypropylene fibers 42 are attenuated and also tend to split along the interface 43 between the cross-sectional regions 41*a*, 41*b*. As a result, a majority of the polypropylene fibers 42 splits or divides into smaller daughter fibers 42*a*, 42*b* before collection on substrate 48 so that the nonwoven web 46 is formed primarily from the daughter fibers 42*a*, 42*b* of polypropylene.

Figure 13:
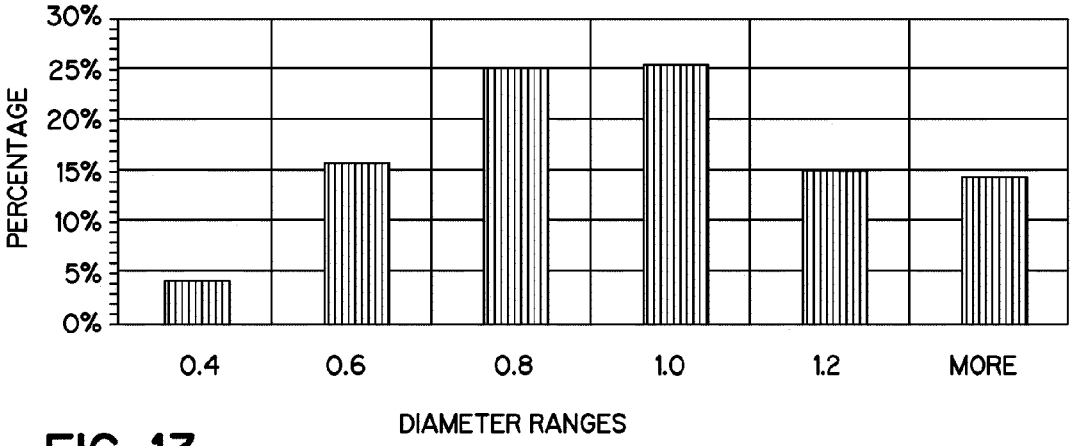
FIG. 13 is a bar graph indicating a distribution of fiber diameters for a meltblown nonwoven web produced from fibers in accordance with the present invention.

FIG. 13 presents the results of measurements of fiber or fiber diameter made at various locations across the width of the nonwoven web 46. As is apparent from FIG. 13, the average fiber diameter was measured to be about 0.94 micron, which is significantly smaller than the average fiber diameter of conventional meltblown nonwoven webs. FIG. 13 indicates that about seventy (70) percent of the nonwoven web 46 was formed from the individual daughter fibers 42*a*, 42*b* resulting from split fibers 42 and having a diameter of less than or equal to one (1) micron.

While the present invention has been illustrated by a description of various preferred embodiments and while these embodiments have been described in considerable detail in order to describe the best mode of practicing the invention, it is not the intention of applicants to restrict or in any way limit the scope of the appended claims to such detail. Additional advantages and modifications within the spirit and scope of the invention will readily appear to those skilled in the art. The invention itself should only be defined by the appended claims, wherein we claim:

What is claimed is:

1. A method of making a nonwoven web from a liquid material, comprising:

establishing a first and second flow of the liquid material;

changing the rheology of the liquid material in the first and second flows, the changed rheology of the second flow differing from the changed rheology of the first flow by an amount sufficient to produce a phase separation between the liquid material in the first and second flows when combined, wherein the liquid materials of the first and second flows are chemically identical both before and after changing rheology;

combining the first flow of the liquid material with the changed rheology and the second flow of the liquid material with the changed rheology to form a plurality of meltblown fibers each having a length, a first cross-sectional region formed of the liquid material from the first flow, and a second cross-sectional region formed of the liquid material from the second flow, the first and second cross-sectional regions extending along the length of each fiber;

separating the first cross-sectional region from the second cross-sectional region along the length of at least a majority of the meltblown fibers to form a plurality of nanofibers; and collecting the nanofibers to form the nonwoven web.

2. The method of claim 1 further comprising:

collecting any un-separated meltblown fibers together with the nanofibers to form the nonwoven web.

3. A method of making a nonwoven web from a liquid material, comprising:

establishing a first and second flow of the liquid material;

changing the rheology of the liquid material in the first and second flows, the changed rheology of the second flow differing from the changed rheology of the first flow by an amount sufficient to produce a phase separation between the liquid material in the first and second flows when combined;

combining the first flow of the liquid material with the changed rheology and the second flow of the liquid material with the changed rheology to form a plurality of meltblown fibers each having a length, a first cross-sectional region formed of the liquid material from the first flow, and a second cross-sectional region formed of the liquid material from the second flow, the first and second cross-sectional regions extending along the length of each fiber;

separating the first cross-sectional region from the second cross-sectional region along the length of at least a majority of the meltblown fibers to form a plurality of nanofibers and impinging the meltblown fibers with air at a velocity effective to split at least the majority of the meltblown fiber into nanofibers; and collecting the nanofibers to form the nonwoven web.

4. The method of claim 3 wherein impinging the meltblown fibers with air further includes:

attenuating the meltblown fibers before splitting.

5. A method of making a nonwoven web from a liquid material, comprising:

establishing a first and second flow of the liquid material;

changing the rheology of the liquid material in the first and second flows by a process including subjecting the liquid material in the first and second flows to different shear histories, the changed rheology of the second flow differing from the changed rheology of the first flow by an amount sufficient to produce a phase separation between the liquid material in the first and second flows when combined;

combining the first flow of the liquid material with the changed rheology and the second flow of the liquid material with the changed rheology to form a plurality of meltblown fibers each having a length, a first cross-sectional region formed of the liquid material from the first flow, and a second cross-sectional region formed of the liquid material from the second flow, the first and second cross-sectional regions extending along the length of each fiber;

separating the first cross-sectional region from the second cross-sectional region along the length of at least a majority of the meltblown fibers to form a plurality of nanofibers; and collecting the nanofibers to form the nonwoven web.

6. The method of claim 5 wherein subjecting the liquid material in the first and second flows to different shear histories further comprises:

extruding the first flow of the liquid material from a first extruder having a barrel of a first diameter; and extruding the second flow of the liquid material from a second extruder having a barrel of a second diameter that differs from the first diameter.

7. The method of claim 1 wherein combining the first and second flows of the liquid material further comprises:

arranging the first and second cross-sectional regions with a side-by-side arrangement extending along the length of each meltblown fiber.

8. The method of claim 1 wherein each of the meltblown fibers includes a third cross-sectional region formed of the liquid from the first flow and extending along the length of each fiber, and combining the first and second flows of the liquid material further comprises:

arranging the third cross-sectional region adjacent to the second cross-sectional region.

9. The method of claim 8 further comprising:

separating the third cross-sectional region from the second cross-sectional region along the length of at least a majority of the meltblown fibers to form nanofibers.

10. A method of making a nonwoven web from a liquid material, comprising:

establishing a first, second, and third flow of the liquid material;

changing the rheology of the liquid material in the first, second, and third flows, the changed rheology of the second flow differing from the changed rheology of the first flow by an amount sufficient to produce a phase separation between the liquid material in the first and second flows when combined and the changed rheology of the third flow differing from the changed rheology of at least one of the first and second flows to produce a phase separation between the liquid material in the third flow and the at least one of the first and second flows when combined, wherein the liquid materials of the first, second, and third flows are chemically identical both before and after changing rheology;

combining the first flow of the liquid material with the changed rheology, the second flow of the liquid material with the changed rheology, and the third flow of the liquid material with the changed rheology to form a plurality of meltblown fibers each having a length, a first cross-sectional region formed of the liquid material from the first flow, a second cross-sectional region formed of the liquid material from the second flow, and a third cross-sectional region formed of the liquid material from the third flow, the first, second, and third cross-sectional regions extending along the length of each fiber;

mutually separating the first, second, and third cross-sectional regions from each other along the length of at least a majority of the meltblown fibers to form a plurality of nanofibers; and collecting the nanofibers to form the nonwoven web.

11. The method of claim 10 further comprising: collecting any un-separated meltblown fibers together with the nanofibers to form the nonwoven web.

12. The method of claim 11 wherein the third flow has a different changed rheology than the first and second flows.

13. A method of making a nonwoven web from a liquid material, comprising:

establishing a first and second flow of the liquid material;

causing the liquid material in the first flow to experience a different shear history from that of the second flow, the shear histories differing by an amount sufficient to produce a phase separation between the liquid material in the first and second flows when combined;

after experiencing differing shear histories, combining the first flow of the liquid material and the second flow of the liquid material to form a plurality of meltblown fibers each having a length, a first cross-sectional region formed of the liquid material from the first flow, and a second cross-sectional region formed of the liquid material from the second flow, the first and second cross-sectional regions extending along the length of each fiber;

separating the first cross-sectional region from the second cross-sectional region along the length of at least a majority of the meltblown fibers to form a plurality of nanofibers; and collecting the nanofibers to form the nonwoven web.

14. The method of claim 13 further comprising:

collecting any un-separated meltblown fibers together with the nanofibers to form the nonwoven web.

15. The method of claim 13 wherein separating the first cross-sectional region from the second cross-sectional region further comprises:

impinging the meltblown fibers with air at a velocity effective to split at least the majority of the meltblown fiber into nanofibers; and collecting the nanofibers to form the nonwoven web.

16. The method of claim 15 wherein impinging the meltblown fibers with air further includes:

attenuating the meltblown fibers before splitting.

17. A method of making a nonwoven web from a liquid material, comprising:

establishing a first, second, and third flow of the liquid material;

causing the liquid material in the first, second, and third flows to experience differing shear histories, the differing shear histories of the first, second, and third flows adequate to produce a phase separation between the liquid material between at least two flows when combined;

after experiencing differing shear histories, combining the first, second, and third flows to form a plurality of meltblown fibers each having a length, a first cross-sectional region formed of the liquid material from the first flow, a second cross-sectional region formed of the liquid material from the second flow, and a third cross-sectional region formed of the liquid material from the third flow, the first, second, and third cross-sectional regions extending along the length of each fiber;

mutually separating the first, second, and third cross-sectional regions from each other along the length of at least a majority of the meltblown fibers to form a plurality of nanofibers; and collecting the nanofibers to form the nonwoven web.

18. The method of claim 17 further comprising: collecting any un-separated meltblown fibers together with the nanofibers to form the nonwoven web.

* * * * *